United States Patent [19]

Lai

[11] Patent Number: 4,836,544

[45] Date of Patent: Jun. 6, 1989

[54] STRUCTURE OF RACKET HANDLES

[76] Inventor: Genhone Lai, 1F, No. 46, Alley 3, Lane 187, Sec. 3, Cheng Kung Rd., Taipei City, Taiwan

[21] Appl. No.: 142,197

[22] Filed: Jan. 11, 1988

[51] Int. Cl.[4] ..... A63B 49/00

[52] U.S. Cl. ..... 273/73 J; 273/75; 273/81.4

[58] Field of Search ..... 273/73 J, 75, 81.4

[56] References Cited

U.S. PATENT DOCUMENTS

| | | | |
|---|---|---|---|
| 3,868,110 | 2/1975 | Jones | 273/75 |
| 3,964,340 | 6/1976 | Antonio et al. | 273/81 R |
| 4,664,381 | 5/1987 | Aaron | 273/75 |

FOREIGN PATENT DOCUMENTS

| | | | |
|---|---|---|---|
| 2213499 | 9/1972 | Fed. Rep. of Germany | 273/25 |
| 2335822 | 12/1974 | Fed. Rep. of Germany | 273/75 |
| 2746168 | 4/1979 | Fed. Rep. of Germany | 273/75 |
| 2815884 | 10/1979 | Fed. Rep. of Germany | 273/75 |
| 2928995 | 4/1981 | Fed. Rep. of Germany | 273/75 |
| 3312927 | 10/1984 | Fed. Rep. of Germany | 273/75 |
| 2485934 | 1/1982 | France | 273/73 J |
| 1389488 | 4/1975 | United Kingdom | 273/75 |

*Primary Examiner*—Robert E. Garrett
*Assistant Examiner*—Thomas Denion
*Attorney, Agent, or Firm*—Bacon & Thomas

[57] ABSTRACT

This invention relates to an improved structure for a racket handle, particularly denoting a design which has a hooking/gripping and force applying point for the forefingers and separate areas for the hooking/holding of the middle, the force and the little fingers set in a descending order from the upper direction of the racket handle. Also designed are a circular swollen convexed section to facilitate the handle-holding motion performed by the center of the palm and the section of hypothenar emience keeping in close touch with the handle to provide similar functions to facilitate the performance of handle holding. This unique design will keep the palm of the player in close and comfortable touch with the racket handle and further match it with the natural structure of the elbow when a ball is being struck, so as to reduce the possibility of sporting injury and help beginners form a proper handle-holding posture to the ultimate end of bringing the skill of racket playing to its full play.

1 Claim, 2 Drawing Sheets

STRUCTURE OF RACKET HANDLES

DETAILED DESCRIPTION OF THE CREATION

The shapes of handles of tennis, squash, badminton and racketball rackets currently used in various important world contest are more or less either of a conventional octagon or oval shape. The face and the entire structure of a racket or even the materials used are often subject to changes or replacement. The object being sought for by such changes is to obtain the greatest explosive force when the ball is being struck or to achieve a more skillful performance. However, as far as the improvement of a racket is concerned, no improvement has ever been made to its handle which will cope more perfectly with the bio-engineering of the human body. It seems that the mode of grasping the handle of a racket or the technique of ball striking is directly involved with the responsibility of the players and couches and does not involve the racket manufacturers. This explains why injuries brought to beginners and some of the world reputed professional players are often heard of. Therefore, a racket which will not only bring its ball striking effect to the fullest but will also prevent the players from being injured is something highly desired by every player. In view of the above description, the inventor focused his research on the following defects which exist when a player is using a conventional racket having an octagon handle:

1. Stress is given to the force applied by the middle finger, little finger and the thumb, without being aware that the force of the forefinger has not been fully applied on the handle.
2. The handle cannot cope with the pattern of space of the center of a palm that makes the handle not be fully grasped by the palm.
3. Due to the protrusive or plain straight shape formed at the end of a conventional octagon or oval handle, the handle of the racket cannot be fully grasped by the center of the palm. Other defects are also produced.

Thus the inventor has the aforementioned structure improved in such a way that 1. a point onto which the force of the forefinger is to be applied is provided to produce an excellent grasping effect for the player; 2. different areas of holding are divided according to the difference of length shown by the points to be grasped and hooked by the middle, ring and the little fingers; 3. a circular swollen protrusive section suitable for the grasping and hooking of the center of a palm is provided and 4. a gradually diminishing shape at the bottom edge of the handle for strengthening the force of grasping is also provided, which will enable the palm of the player to grasp the handle in a more natural and easier manner to meet the requirement of the bio-engineering of the human body, enhance the controlling capability of the ball and the accuracy of the motion. Moreover, it will also reduce the possibility of injury caused by strain to such ligman categorized under the flexor muscle system of the forearm as the tennis elbow.

DETAILED DESCRIPTION OF A PREFERRED EMBODIMENT

Figure 3:
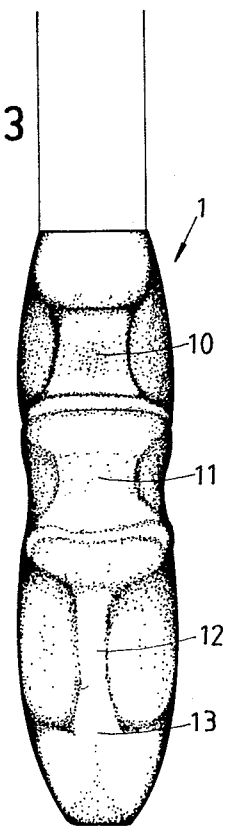
FIG. 3—The left lateral view of the invention.
Figure 2:
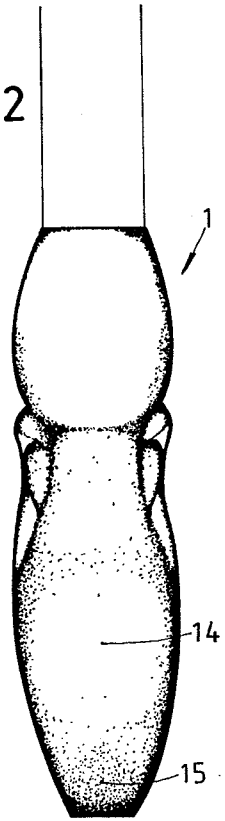
FIG. 2—The right lateral view of the invention.
Figure 1:
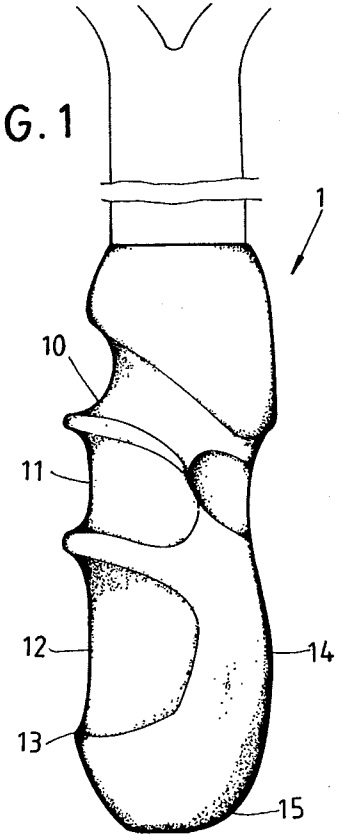
FIG. 1—A right side view of the invention.
Figure 4:
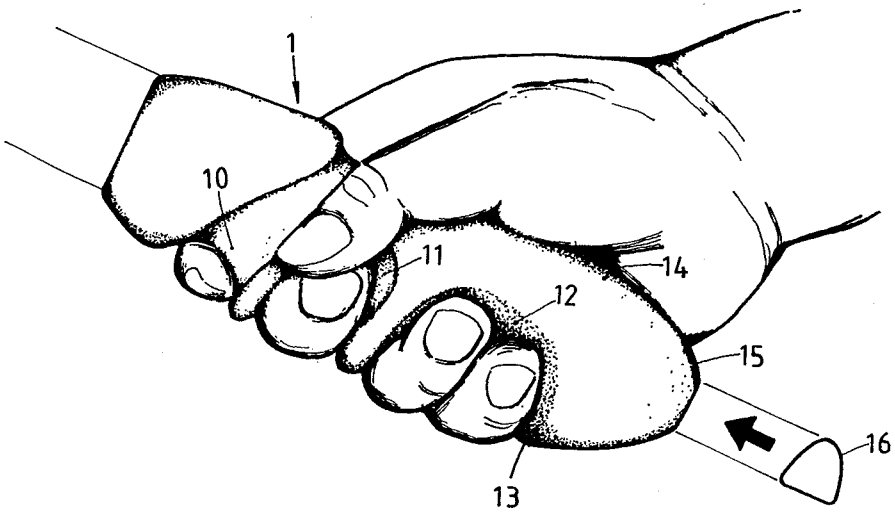
FIG. 4—A perspective view of the invention in use.

A racket sport is a term collectively denoting the games of tennis, squash, badminton and racketball which provides a thorough body movement for the player. It involves such motions as the catching and striking of a ball and in the instance when a ball is being served at the extreme end of the playground. The key motion of the aforementioned sports can be traced back from the face part of the racket to the point of contact with the human body in the order of fingers, palm, wrist, forearm, upper arm, shoulder, etc., among which the fingers, palm and wrist are the actual points of contact, to which the command given by the brain will be finally conveyed. At that moment, whether or not the palm and fingers of the player fit exactly and confortably with the handle of the racket will directly affect the full conveyance of the command given by the brain and the excesssive or insufficient control to be exerted over the force applied on the handle. Such influence can be gradually felt by a beginner soon after he started with this racket lesson. One has to go through a considerable long period of handle holding and ball control practice before he/she can manage to regulate the conveyance of the command of the brain through the execution of the palm and fingers to vary the mode of handle holding and ball striking. However, this is also a period during which sporting injury is most likely to happen and thus shorten the career of a sportsman. In view of these defects, the focal point of research of the present creation lay in the study of the tissue of the muscles of arms, palms and bones of the human body, as well as the principle of their distribution, trying as much as possible to avoid changing forcibly the natural structure of the human body, so as to design a mode which will be most excellent and favorable for the handle holding of a racket and will prevent muscle injury by strain from happening. AS shown in FIG. 1, a racket handle 1 having three concave arc segments extended in a descending order at one side, where the first concaved arc segment of a circle serves as a face, on which the force of handle holding can be applied. The second concaved arc segment 11 serves as a part of holding for the middle finger and the third concaved arc segmen serves as a part of holding for the ring and the little fingers. A protrusive part 13 at the extreme end of segment serves as a checking point; another side of the racket handle opposing the forementioned three concaved arc segment is in the shape of a curve, defining at its middle section close to the extreme end of the handle a slightly protrusive arc 14 suitable for the holding of the palm is set and, the extreme end of the handle is being cut thinner 15 toward the bottom shape 16. As shown in the right lateral view of FIG. 2 and the left lateral view of FIG. 3, it can be seen that the model of this creation is designed strictly according to the shape of the fingers, so as to enable the palm of the player to hold the racket handle 1 in a most comfortable manner. In order to provide a better understanding of how the concept of this invention fully copes with the principles of science and medical theory, various related drawings and illustrations are described as follow:

A-1. The face on which the force for racket handle holding/hooking motion applied by the forefinger 10:

The conventional mode of racket handle holding differs from the daily mode of article holding. In order that the mode of handle holding will be kept as much as possible in such a posture that an obtuse angle will be formed between the racket handle and the forearm of the player so that the force exerted by the arm will be fully conveyed to the handle and the face of the racket, it is so designed that, at the time of holding the handle, the central line of the handle will be slantingly extended from the base of the first section of forefinger across the entire length of the palm face until it reaches the outer lateral section close to the wrist of the palm face. In other words, the aforementioned central line is located at the place where the so-called Hypothenar Eminence is disposed (per the drawings shown by Page 1 and Page 2 of the applicant's submission of prior art dated 1/11/88, hereinafter, applicant's prior art.) Now, by observing the basic mode of racket handle holding (per the drawings of Page 1 through Page 3 of the applicant's prior art), it can be seen that the forementioned mode of racket handle holding is characterized for having the forefinger stretched forward, so positioned that it will be slightly separated from the other four fingers. In this way, the lateral side of the forefinger close to the middle finger will suffer a loss of its force of application due to the lacking of a section on which the said force can be applied. Consequently, the force provided by the forefinger cannot be fully exerted, though, at the meantime, a force has already been fully exerted by the other four fingers. By analyzing the structure and the function of the muscles of the forefinger, it can be seen that the three flexor muscles which exerted their control over the holding of articles in an inward direction by the functioning of the three sections of the forefinger are categorized as follow:

(1) Mm. Lumbricales: activates the inward bending motion of the first section of ingers;
(2) M. Flexor digitorum profundus: activates the inward bending motion of the second section of fingers; and
(3) M. Flexor digitorum profundus: activates the inward bending motion of the third section of fingers.

Speaking in terms of the forementioned three muscles, it is found that, at the time when the player is holding a conventional racket handle with strain, only the Mm. Lumbricales of the forefinger will exert a full strain to sandwitch the handle in synchronization with the thumb, while the rest of the M. Flexor digitorum superficialis and the M. Flexor digitorum profundus, when they reached the second and the third section of fingers, will fail to exert their full force due to the lacking of a stable point of hooking/gripping. If a full force is being exerted, the forefinger is apt to shift its position and thus will weaken its effort over the racket handle. What is most important of all is that the forefinger has to conduct the longest and most slantingly hooking motion on the handle, though it is comparatively shorter in length than the middle finger. However, this is contrary to the principle of Bio Engineering. It will reduce the force of control exerted and the function provided by the palm over the entire racket handle. On the contrary, the design of the handle provided by this creation is characterized for having the the hooking-/holding section of the forefinger cut to become concave in shape and, the face 10 on which a force is to be applied (per FIG. 1) is set in proportion to the degree of arc and the length of the face of the finger to shorten its long slanting distance to further enable the muscles of the other fingers to apply their force evenly, so as to strengthen the capability of control exerted by the fingers over the handle. In addition to the forementioned functions, the design of this force applying face 10 provided for holding/hooking purpose can also enable the force exerted to the handle to be no longer concentrated in the narrow areas of the thumb, the middle and the ring fingers. By bringing the hooking/holding motion of the forefinger into its full play, the force of the other fingers will then be exerted evenly, and the proper posture and accuracy of ball striking will also be upgraded (because the end of the forefinger has a very sensitive nerve and such instinct function as direction guidance and command giving.) This is more obvious when it gets in full touch with objects in its movement.

A-2. The section of the palm in close touch with the handle:

The design of this section is similar to that of the slightly convexed arc shape 14 which helps the palm to fit more firmly with the handle. As the shape of that particular part of a conventional racket handle is either plain and straight or concaved, some of the sportsmen will, in an attempt to hold the handle firmly in their hand, allow their palms to hold firmly at the slightly convexed section of the extreme end of the handle. This will allow the Hypothenar Emience of their palms and little fingers free from engagement. As for ordinary players, they only know how to grasp the handle tightly with their fingers but cannot, at the same time, pay attaention to see whether their palms can also fit tightly with the handle. Analyzing in terms of the shape and the structure of the face of the palm, it can be seen that the face of the palm is somewhat in the shape of a shallow dish (as shown by the drawings from Page 1 through Page 5 of the applicant's prior art). The two lateral parts close to the wrist are protrusive muscles which becomes more concaved at a position when it is getting nearer to the center of the palm. If the entire center of the palm is drawn out by lines, the most concaved part shown is called the center of the palm. Its position lies somewhat at the lower direction between the Capitulum of the Ossa Metacarpi of the third and fourth bone of the palm (as shown by Point B of page 1 through page 6 of the applicant's prior art). By analyzing the muscular tissue of the interior of the center of the palm (please refer to page 7 through page 8 of the applicant's prior art), it can be seen that its interior layers which extended inwardly comprises of Aponeurosis palmaris, Lig. Palmare transversum subcutaneum, Vagira tendinum mm. flexorum digitorum comnunium and the M. flexor digitorum superficialis and profundus which are wrapped in the interior (not shown in the drawing), etc. These Aponeurosis palmaris located in the interior of the center of the palm and the finger muscles wrapped in the interior formed important muscles to perform the motion of bending and handle holding after they have passed through the center of the palm and further extended until they reached the sections of various fingers and their extreme ends. At this time, if the center of the palm cannot fit exactly to the racket handle, the shape of holding the handle would be somewhat like clipping it between the sections of fingers and the ball-shaped muscle of the thumb, instead of having it thoroughly held by the entire palm and fingers. Since the palm cannot hold the handle fully within its grip, the various M. flexor digitorum superficialis and profundus in the interior of the palm 14 have to produce a stronger load of force, though the effort they produced are comparatively small. On the contrary, if the slightly convexed arc shape of this creation is provided for handle holding, the palm will then be able to hold the handle in its full grip wherein the force of varius M. flexor digitorum superficialis and profundus will be exerted in full onto the racket handle to produce a greater effort onto the racket handle at a smaller load of force, so as to obtain a better stability and a stronger force of control to be exerted by the palm over the racket handle to the attainment of higher accuracy in the performance of ball striking and catching as well as in other related motion.

A-3. The handle holding separately performed by the middle, the ring and the little fingers Viewing in terms of the condition under which the handle is being held by the fingers, the best central point to be held and gripped by the three fingers other than the thumb and forefinger is the face of the central bone of fingers (i.e. the second section of fingers) because the force exerted when it is being applied leans in a straight direction toward the space between the center of the palm and the ball-shaped muscle of the thumb (i.e. the point of support of stress). In addition, because of the irregular length of the fingers, the distance at which the faces of various middle sectioned bones of fingers corresponding to the plane at the upper direction of the racket handle when the handle is being held (i.e. the ball-shaped muscle of the thumb will grip and press against the force applied face of the racket handle) is also irregular. Therefore, it is concluded that a conventional racket handle which is equal in its peripheral length and in a plain and straight shape is not considered as an ideal model for players. As shown by the drawings of page 1 through page 9 of the applicant's prior art, the middle sections of fingers, particularly those of the middle, ring and little fingers, are set in a curved line instead of a straight one. Therefore, it would be ideal if the peripheral length of a racket handle can be set proportional to the length of various fingers to provide an excellent force applied position and direction for various fingers and to further produce an excellent corresponding points of the ball shaped muscle of the thumb and the edge of the palm, so as to form an even wrapping force to the racket handle. For example, as shown in a descending order in FIG. 1, the second concaved arc is a holding section 11 for the middle finger and the third concaved arc is the holding section 12 for the ring finger and the little finger. The forementioned two sections are being separated to allow the flexible muscle of the finger to wrap and grip the racket handle in a slightly radial direction and prevent them from being widely separated. Furthermore, as the ring finger and the little finger are usually of a synchronized motion, it is deemed a natural design to have the forementioned two fingers set in one section so that no position moving will be affected by the exertion of force, as well as to fully enable the firefinger, the palm and the thumb to wrap and hold in a more perfect mode to match with the shape of the palm and fingers.

A-4. The section of the Hypothenar Emience which keeps in close touch with the handle The shape of the section located at the Hypothenar Emience of conventional racket handles is either plain or rising, (because it is close to the end of the handle) and is contrary in shape to that of the interior space of Hypothenar Emience when the palm is holding the handle, as shown in page 1 through page 10 of the applicant's prior art. When the palm is being unfolded, the highest point of hypothenar emience lies at a location close to the wrist, the second highest point lies at the exterior lateral side and, then, it will gradually move toward the center of the palm until it becomes concave in shape. When the handle is being partially held, the area of this section will gradually diminish until it becomes protrusive. When the handle is being fully held, the center of the palm and the bottom end line of the racket handle will form an obtuse triangular angle having its bottom edge risen until it gradually descend into the center of the palm to form a concave shape and, the variance of its height is found to be greater than that of the palm when it is being unfolded. Therefore, in order to match will the protrusive shape formed at the bottom edge, the shape of the racket handle lying at the space which extended backward at the point where the handle is being held firmly by the center of the palm until it gets in touch with the Hypothenar Emience should stretch backward to form a concave shape (the thinned section 15 located at the extreme end of the racket handle in FIG. 1). If the forementioned section is having a rising part similar to the handle sleeve of a conventional racket, the center of the palm is likely to be kept in a high posiition farther away from the racket handle. In addition, what is worth mentioning is that a handle sleev is found rising from the extreme end of a conventional racket handle. By conceptions, it seems that the forementioned handle sleeve will help check the Hypothenar Emience at the outer lateral slope. However, as indicated by practicality, no obvious checking effect will be produced by it other than causing an uncomfortable feeling to the bone of the wrist. Because no backward force for exertion to the protrusive handle sleeve has been produced at the outer lateral slope of the Hypothenar Emience, the force actually produced lies in the wrapping/holding force produced at the slope of the center of the palm corresponding to the grip made by the forefinger. Therefore, the rising part located at the extreme end of the third concave arc as shown by FIG. 1 is the actual checking point of the forementioned force.

The analysis of the above-mentioned four items focussed on explaining, in terms of the bio-engineering of the human body, the various effect provided by the design of this creation. The description set below put emphasis on pointing out the effect in the prevention or reduction of sporting injury provided by this creation. (Please refer to page 1 through page 11 of the applicant's prior art.):

(1) The lateral epicondylitis is a disease which will usually cause pain to a person when the common extensor tendon and the lateral collateral ligment are pressing down. That is to say, these two sections are injured by tearing.

(2) The radiohumeral bursit at the joint of the radius and the ulna.

(3) Annulau ligment strain.

The above-mentioned three sections are the part of origin of most of the extensor muscular system of the forearm. The extensor muscles of this part which related to racket sports shown respectively in page 12 through page 16 of the applicant's prior art are as follow:

(1) M. extensor carpi radialis longus;
(2) M. extensor carpi radialis breuis;
(3) M. extensor digitorum communis;
(4) M. extensor carpi uinaris;
(5) M. supinator.

The above-mentioned muscles originated from the lateral or the annular ligment and descended along the forearm. Except the M. supinator, all the rest of these muscles will pass through the lig, carpi dorsale until they reached and stopped at the bones of the palm or the fingers. Speaking in terms of racket sport motion, the natural structure of the forearm of the human body or the fore-limb of a four limbed animal are usually more fully developed and powerful in their inward bending function than in their stretching function. For instance, the blow, strike and hooking motion in a bending or lateral direction made by the paw or hand are usually powerful. In racket sports, however, many unique motions such as striking the racket in a backward direction or an inverted blow are found in the racket sports. According to the principle of mechanics, the superiority of an invert blow of the racket sets at the end of the face of the racket to cope with the force exerted by the extensor muscle of the arm which will produce the function of lever. That is why in a racket sport, a heavier load is expected to be borne by the extensor muscle than in any other sports. Therefore, a physical training or warm-up exercise prior to the contest should be given to the extensor muscle system. Otherwise, any attempt to exhaust the strength as much as possible from the shoulder and the large arm above the waist by using the wrist will easily get the extensor muscles involved with the section of the upper innomonate bone and cause injury to the player. If the player uses a racket with a conventional handle, instead of having the availability of a force which can get in touch confortably with the racket handle so that the stability of handle will be strengthened, more trouble will be caused. Therefore, this invention provides a better and a more accurate wrapping/holding force for the palm over the racket handle. Although a thorough protection to extensor muscular system, the radius and the ulna still cannot be provided, an appropriate protection to the forementioned section of the human body being affected under a certain direct or indirect good influence has effectively been provided to reduce the possibility of injury. For example:

(1) A good posture of handle holding will help produce an even wrapping/holding force which will reduce the load borne by the extensor muscles. In the ball game, under the influence of the function of resistance exerted by the extensor muscles and the flexor muscles, the load borne by the extensor will be correspondingly reduced.

(2) A handle holding posture which copes with the principle of bio-engineering will enable various muscles (particularly that of the wrist) to function at a normal position to prevent the performance of any unnecessary or excessively extensive motion. On the contrary, in a conventional racket handle, the holding force is found to be stressed on the thumb, the middle and the ring fingers because no proper grip has been made by the forefinger. The thumb, in particular, has to exert a more powerful force. For the purpose of conducting a powerful grip, strain has to be made frequently by the M. adductor policis in the interior of the thumb. In so doing, the second and third bones of the palm located at the part of origin is equivalent to the checking point of the long and the short muscles of radius, lateral art. radiocarpicus. At the time of an invert strike or a backward strike, the long and the short muscles or radius, lateral art. radiocarpicus will indurectly bear the force exerted by the M. adductor policis. However, when speaking in terms of the racket handle of this creation, the effort of the hypothenar emience and the grip made by the forefinger will enable the extensor muscle to produce a better function of liver to reduce the necessary tension of the extensor muscle, so as to reduce the possibility of injury.

(3) The handle sleeve rising from the extreme end of a conventional racket handle will, at the time of handle holding, directly get in touch with the bone of the wrist. It will, at the instance of striking the ball, indirectly convey the vibrating force onto the ligment of the wrist and passing through the ulna until it reaches the annular ligment of the ulna at the upper end. Because the forementioned force is of the nature of a sudden shocking force, a more serious injury will be produced comparing with that which is caused by an ordinary strain. As the design of the racket handle focussed on having the ball-shaped muscle of the hypothenar emience as the point of contact, the flesh cushion of this section will help offset or absorb the vibration, so as to reduce the instant shocking force brought to the ligment of the radius and the ulna and the articular sacciformis.

What is claimed:

1. A racket handle for grasping by the fingers and palm of a user so as to enhance performance and minimize injury during playing of racket sports, which handle comprises:

(a) an elongate body for attachment to a racket body and provided with a free end, the body including first and second opposed longitudinal sides;

(b) The first longitudinal side having a substantially symmetrical configuration defined by:

(i) a first concave arc segment configured for engagement by an index finger;

(ii) a second concave arc segment configured for engagement by a middle finger;

(iii) a third concave arc segment configured for engagement by both a ring and a little finger; and (iv) the third concave arc segment terminating in an outwardly protruding portion adjacent the end of the handle for providing a checking point against the force produced when the handle is grasped by the user;

(c) The second longitudinal side having a substantially symmetrical configuration defined by a protruding arcuate section for engagement by the center of a palm; and (d) the free end of the handle tapering to a bottom face having a substantially triangular configuration.

* * * * *